US010995767B2

(12) United States Patent
Pirouzpanah

(10) Patent No.: US 10,995,767 B2
(45) Date of Patent: May 4, 2021

(54) HIGH EFFICIENCY FORWARD CURVED IMPELLER AND METHOD FOR ASSEMBLING THE SAME

(71) Applicant: Regal Beloit America, Inc., Beloit, WI (US)

(72) Inventor: Sahand Pirouzpanah, Miamisburg, OH (US)

(73) Assignee: REGAL BELOIT AMERICA, INC., Beloit, WI (US)

( * ) Notice: Subject to any disclaimer, the term of this patent is extended or adjusted under 35 U.S.C. 154(b) by 309 days.

(21) Appl. No.: 15/969,408

(22) Filed: May 2, 2018

(65) Prior Publication Data

US 2019/0338782 A1 Nov. 7, 2019

(51) Int. Cl.

*F04D 29/30* (2006.01)
*F04D 29/28* (2006.01)
*F04D 29/62* (2006.01)

(52) U.S. Cl.

CPC ..... *F04D 29/30* (2013.01); *F04D 29/283* (2013.01); *F04D 29/624* (2013.01)

(58) Field of Classification Search

CPC ..... F04D 29/242; F04D 29/283; F04D 29/30; F04D 29/624; F04D 29/666

See application file for complete search history.

(56) References Cited

U.S. PATENT DOCUMENTS 3,412,929 A 11/1968 Greenheck
5,988,979 A 11/1999 Wang
7,909,571 B2 3/2011 Wu et al.
8,684,676 B1 4/2014 Kirkpatrick
8,881,396 B2 11/2014 Hall et al.
9,453,512 B2 * 9/2016 Tadokoro ..... F04D 17/04
2013/0259669 A1 * 10/2013 Tadokoro ..... F04D 29/283 415/185
2017/0317624 A1 11/2017 Mullin et al.
2017/0342992 A1 11/2017 Pirouzpanah et al.

OTHER PUBLICATIONS

Related Indian design application No. D297342, "Blower Housing", dated Sep. 7, 2017.

Related pending U.S. Appl. No. 62/599,170, "A Centrifugal Blower Assembly and Method for Assembling the Same", filed Dec. 15, 2017.

* cited by examiner

*Primary Examiner* — Kenneth Bomberg
*Assistant Examiner* — Julian B Getachew
(74) *Attorney, Agent, or Firm* — Armstrong Teasdale LLP

(57) ABSTRACT

A fan blade for a fan impeller is coupled to a front endring and a rear endring. The fan blade includes a first portion, a second portion, a third portion, a leading edge, and a trailing edge. The second portion is positioned on a first side of the first portion. The third portion is positioned on a second side of the first portion. The leading edge defines a leading edge blade angle and the trailing edge defines a trailing edge blade angle. The leading edge blade angle and the trailing edge blade angle are constant within the first portion and the leading edge blade angle and the trailing edge blade angle vary within the second portion and the third portion.

18 Claims, 14 Drawing Sheets

HIGH EFFICIENCY FORWARD CURVED IMPELLER AND METHOD FOR ASSEMBLING THE SAME

BACKGROUND

The field of the disclosure relates generally to centrifugal fans, and more specifically, to high efficiency forward curved impeller blades for centrifugal impellers.

Centrifugal fans or blowers are commonly used in the automotive, air handling and ventilation industries for directing large volumes of forced air, over a wide range of pressures, through a variety of air conditioning components. Fan impellers, such as centrifugal fan impellers, are used in a wide variety of applications. Many of these applications utilize a centrifugal impeller with a forward curved blade design, often referred to as a forward curved fan. A forward curved fan wheel has the advantage of being relatively compact in size relative to the volume of air that it can move. In contrast, a centrifugal fan wheel with backward curved blades is typically larger than and rotates at a greater speed, than a comparable forward curved fan. It is for this reason that forward curved fans are used in many residential, commercial, industrial, and automotive applications. Furthermore, at least some known forward curved fans include blade designs that include a constant inner diameter and constant inner and outer blade angles. Such blade profiles may decrease the blade's efficiency because the blades may not uniformly intake air across an entire blade span.

BRIEF DESCRIPTION

In one aspect, a fan blade for a fan impeller is provided. The fan blade is coupled to a front endring and a rear endring. The fan blade includes a first portion, a second portion, a third portion, a leading edge, and a trailing edge. The second portion is positioned on a first side of the first portion. The third portion is positioned on a second side of the first portion. The leading edge defines a leading edge blade angle and the trailing edge defines a trailing edge blade angle. The leading edge blade angle and the trailing edge blade angle are constant within the first portion and the leading edge blade angle and the trailing edge blade angle vary within the second portion and the third portion.

In another aspect, a fan impeller is provided. The fan impeller includes a front endring, a rear endring, and a plurality of fan blades coupled between the front endring and the rear endring. At least one of the plurality of blades includes a first portion, a second portion, a third portion, a leading edge, and a trailing edge. The second portion is positioned on a first side of the first portion. The third portion is positioned on a second side of the first portion. The leading edge defines a leading edge blade angle and the trailing edge defines a trailing edge blade angle. The leading edge blade angle and the trailing edge blade angle are constant within the first portion and the leading edge blade angle and the trailing edge blade angle vary within the second portion and the third portion.

In yet another aspect, a method of assembling a fan impeller is provided. The method includes providing a front endring and a rear endring. The method also includes coupling a plurality of fan blades to the front endring and the rear endring. At least one of the plurality of blades includes a first portion, a second portion, a third portion, a leading edge, and a trailing edge. The second portion is positioned on a first side of the first portion. The third portion is positioned on a second side of the first portion. The leading edge defines a leading edge blade angle and the trailing edge defines a trailing edge blade angle. The leading edge blade angle and the trailing edge blade angle are constant within the first portion and the leading edge blade angle and the trailing edge blade angle vary within the second portion and the third portion.

DETAILED DESCRIPTION

Figure 1:
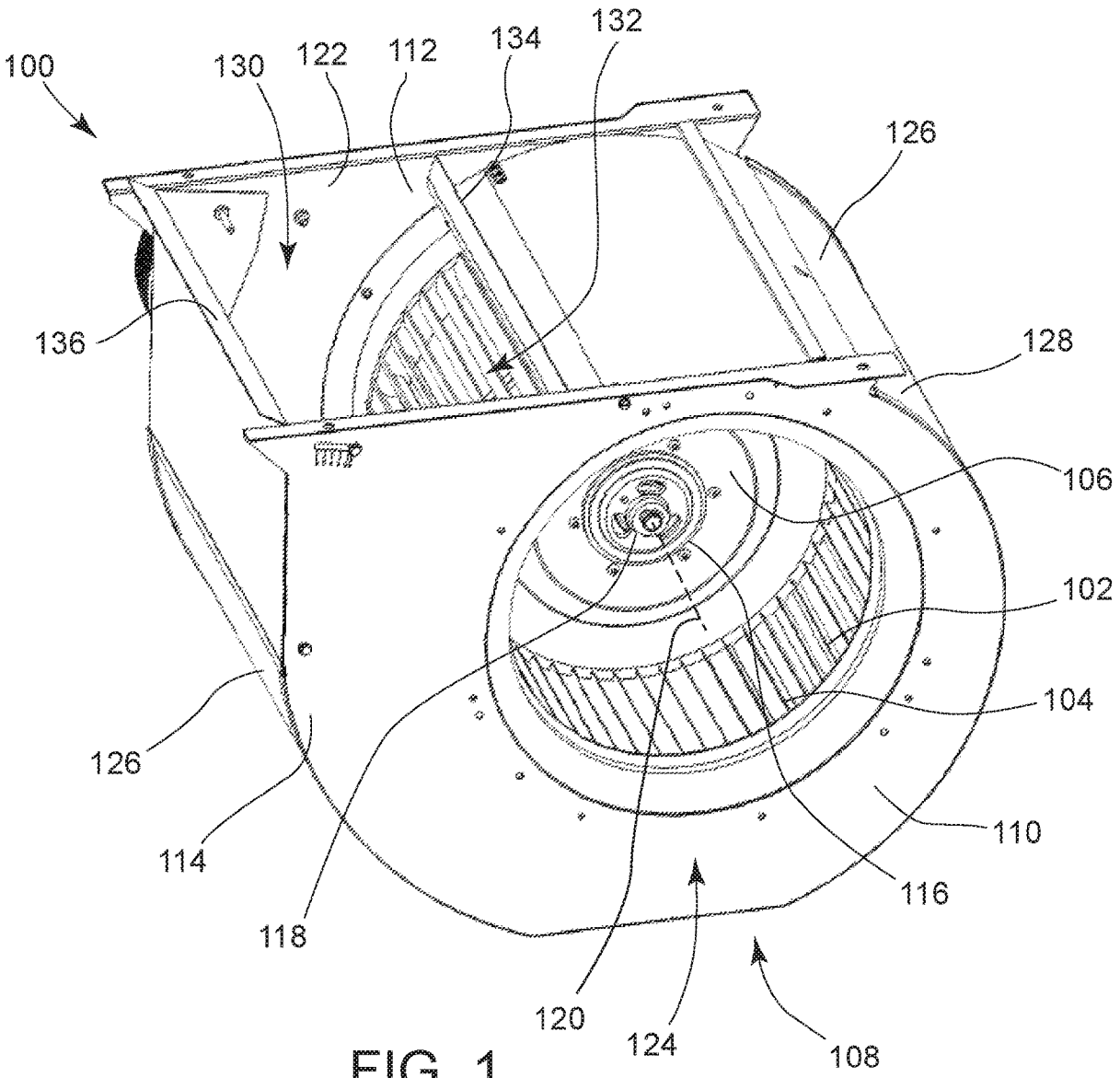
FIG. 1 is a perspective view of an exemplary blower assembly.

The embodiments described herein relate to a centrifugal fan or blower. More specifically, embodiments relate to high efficiency forward curved impeller blades for centrifugal fans or blowers. FIG. 1 illustrates an exemplary embodiment of a centrifugal fan or blower assembly 100. Blower assembly 100 includes at least one impeller 102 that includes a plurality of fan blades 104 positioned circumferentially about impeller 102. Impeller 102 is further coupled to a wheel hub 106. Blower 100 further includes a housing 108 comprising a rear portion 110 and a front portion 112. Rear portion 110 includes a sidewall 114 through which a motor 116 is inserted. Motor 116 includes a shaft 118 that engages hub 106 to facilitate rotation of impeller 102 about an axis 120. Front portion 112 of housing 108 also includes a sidewall 122. Sidewalls 114 and 122 each include an inlet 124 through which a volume of air is drawn by impeller 102. Moreover, blower 100 includes a scroll wall 126 defining a blower circumference 128 and is positioned between sidewall 114 and sidewall 122. Scroll wall 126 extends circumferentially from a cut-off point 134 about a blower chamber 130 to a scroll wall end point 136 and covers a portion of blower circumference 128. Scroll wall 126 is positioned progressively further from impeller 102 in the direction of rotation to accommodate the growing volume of air due to the scroll shape of chamber 130. During operations, motor 116 rotates impeller 102 to draw air through inlet 124, passing it around blower chamber 130, and exhausting it through an outlet 132. In the exemplary embodiment, blower assembly 100 includes a single impeller 102 and inlet 124, alternatively, blower assembly 100 may include more than one wheel and/or inlet.

Figure 2:
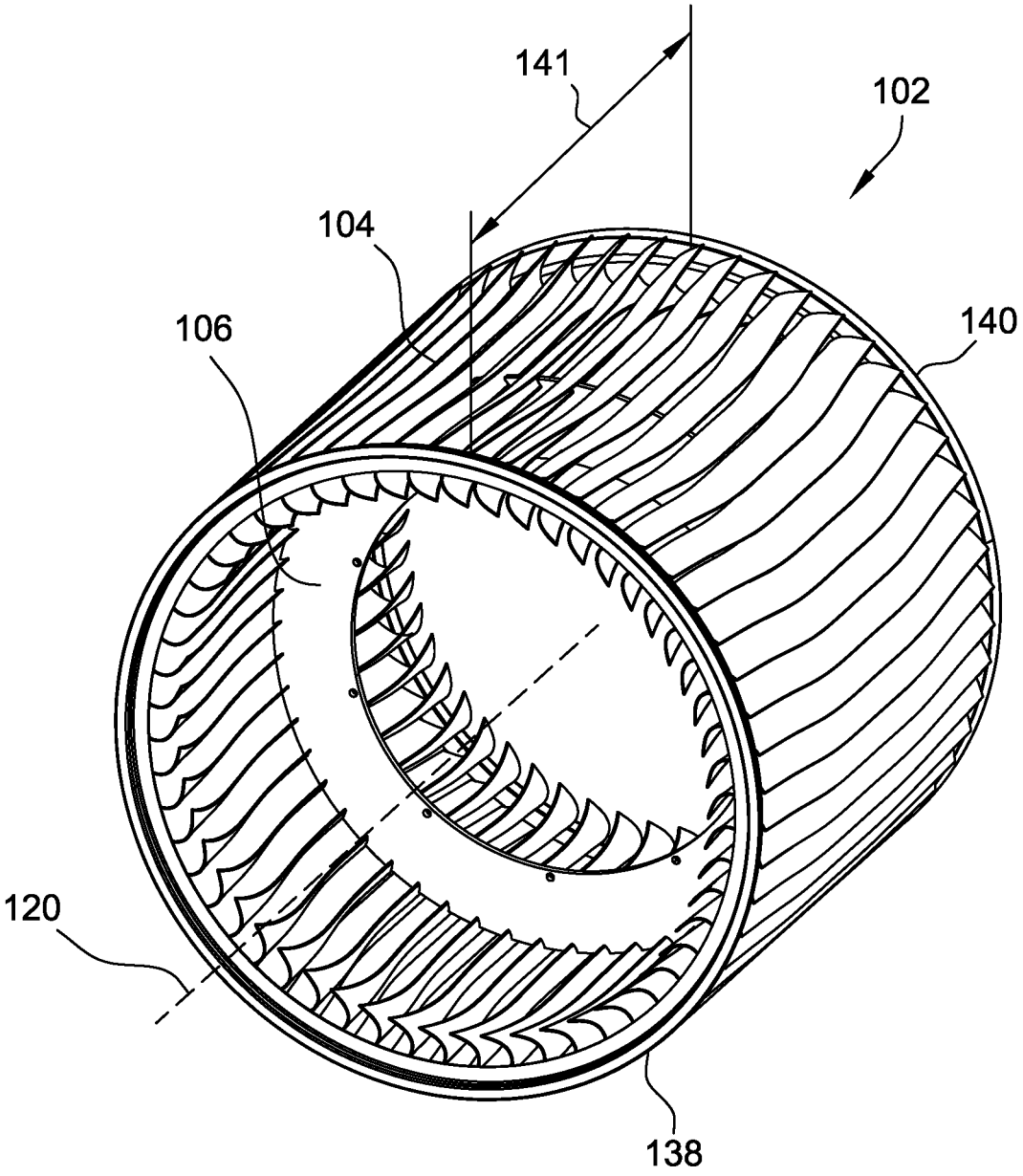
FIG. 2 is a schematic perspective view of exemplary impeller for use in the blower assembly shown in FIG. 1.

FIG. 2 is a schematic perspective view of exemplary impeller 102 including fan blades 104. In the exemplary embodiment, fan blades 104 are coupled between a front endring 138 and a rear endring 140 such that a blade span 141 is defined therebetween. Fan blades 104 are oriented such that impeller 102 is a forward curved fan. Alternatively, impeller 102 may be a backward curved fan or any fan type that facilitates operation as described herein. Endrings 138 and 140 are coaxial or substantially coaxial with an axis 120. Fan blades 104 are attached to rear endring 140 and/or front endring 138 such that a longitudinal axis of fan blades 104 is substantially parallel to axis 120. Fan blades 104 are configured to pull in air along axis 120 and eject the air radially outward when rotated about axis 120 together with rear endring 140 and front endring 138. Fan blades 104 may be attached to rear endring 140 and/or front endring 138 in any manner that permits impeller 102 to operate as described herein. In operation, motor 116 is configured to rotate impeller 102 about axis 120 to produce a flow of air for a forced air system, e.g., a residential or commercial HVAC system.

Figure 3:
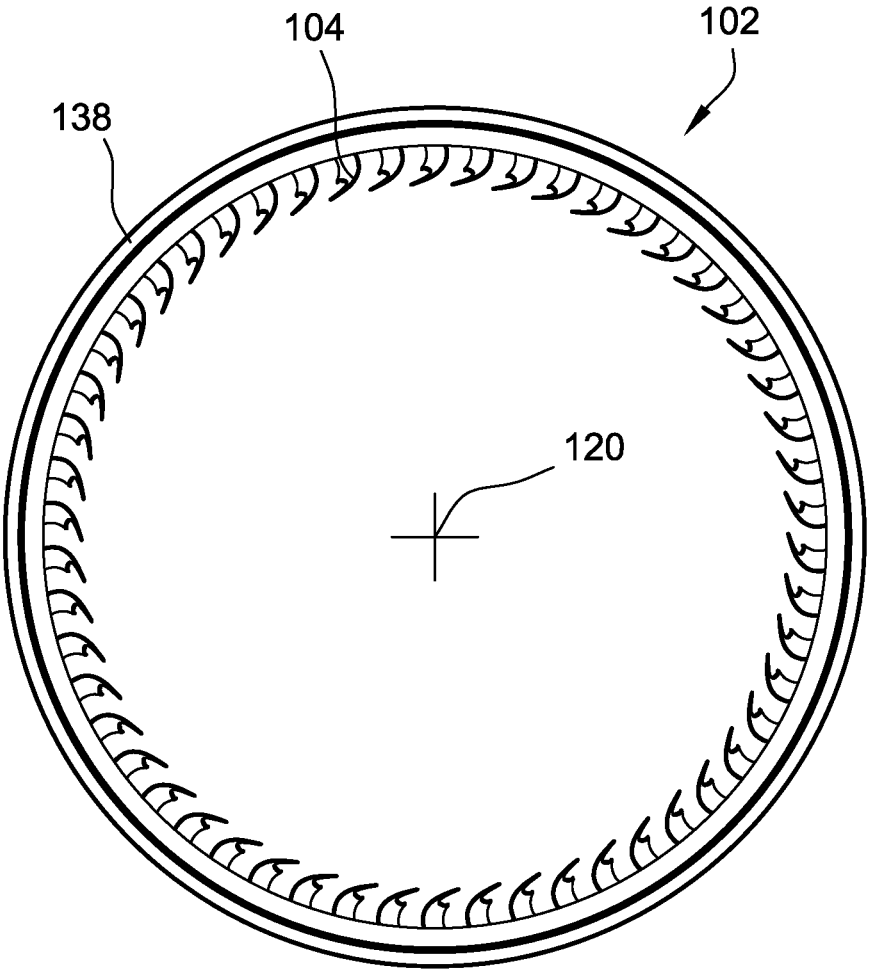
FIG. 3 is a schematic side view of exemplary impeller shown in FIG. 2.
Figure 4:
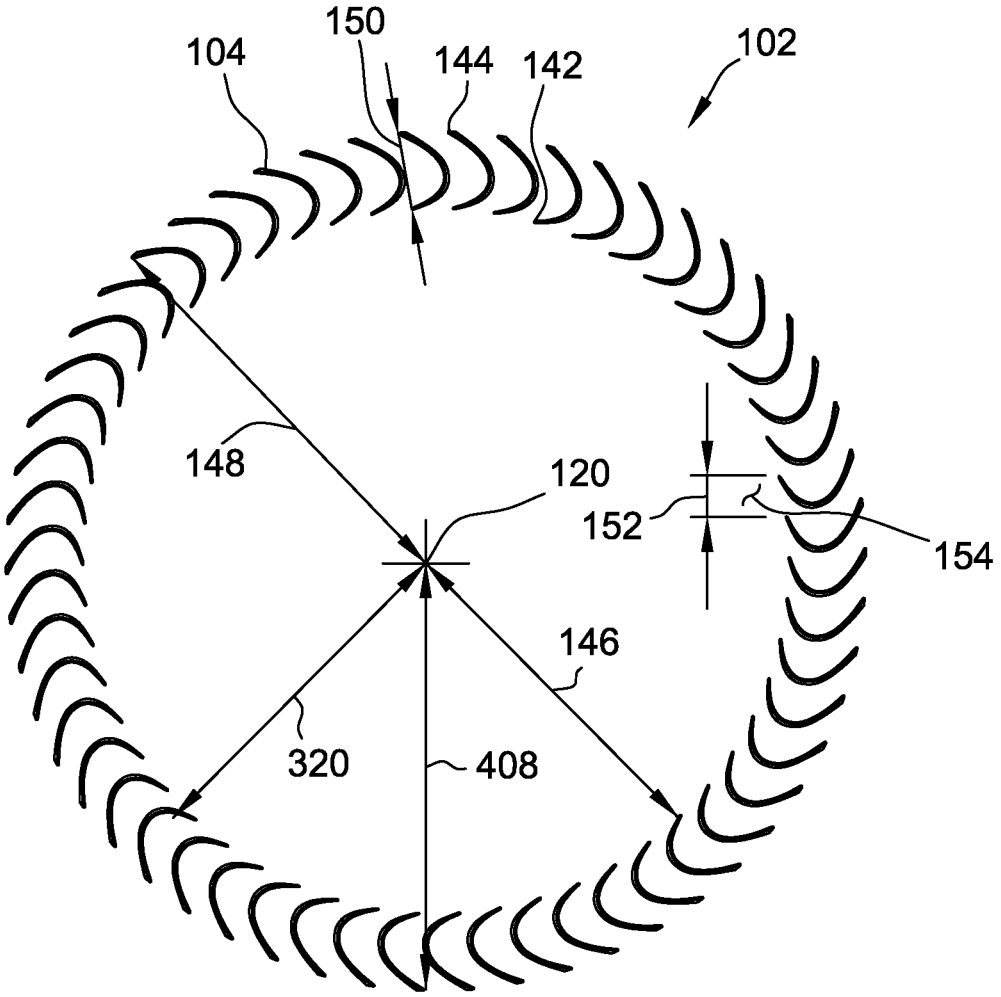
FIG. 4 is a schematic side view of exemplary impeller shown in FIG. 2 with endrings removed for clarity.

FIG. 3 is a schematic side view of exemplary impeller 102 including fan blades 104 with a portion of wheel hub 106 removed for clarity. FIG. 4 is a schematic side view of exemplary impeller 102 including fan blades 104 with endrings 138 and 140 and a portion of wheel hub 106 removed for clarity. In the exemplary embodiment, each fan blade 104 includes a leading edge 142, a trailing edge 144, an inner radius 146, $r_i$, an outer radius 148, $r_o$, and a chord length 150, $C_l$. Inner radius 146 is defined as the distance between leading edge 142 and axis 120. Outer radius 148 is defined as the distance between trailing edge 144 and axis 120. Chord length 150 is defined as the distance between leading edge 142 and trailing edge 144. Additionally, impeller 102 includes a predetermined number of fan blades 104, $n_b$. In the exemplary embodiment, impeller 102 includes 54 fan blades 104. Alternatively, impeller 102 may have any number of fan blades 104 that enables blower assembly 100 to function as described herein. Additionally, a blade distance 152 is defined as a distance between adjacent leading edges 142 of adjacent fan blades 104. In the exemplary embodiment, blade distance 152 is constant between all fan blades 104. Alternatively, blade distance 152 may vary between fan blades 104. Additionally, each fan blade 104 has a pitch 154, p, or blade distance 152.

In the exemplary embodiment, impeller 102 has a blade solidity, $B_s$, which is defined as the ratio of chord length 150 to pitch 154 as shown Eqn. 1 below.

$$B_s = \frac{C_1}{p} \qquad \text{Eqn. 1}$$

Pitch 154 is defined as the ratio of the circumference of a mean radius of fan blades 104, $r_m$, to predetermined number of fan blades 104, $n_b$ as shown in Eqn. 2 below.

$$p = \frac{2\pi r_m}{n_b} \qquad \text{Eqn. 2}$$

The mean radius of fan blades 104, $r_m$, is defined by Eqn. 3 below.

$$r_m = \frac{r_i + r_o}{2} \qquad \text{Eqn. 3}$$

In the exemplary embodiment, the blade solidity remains constant as inner radius 146 varies along blade span 141.

Figure 5:
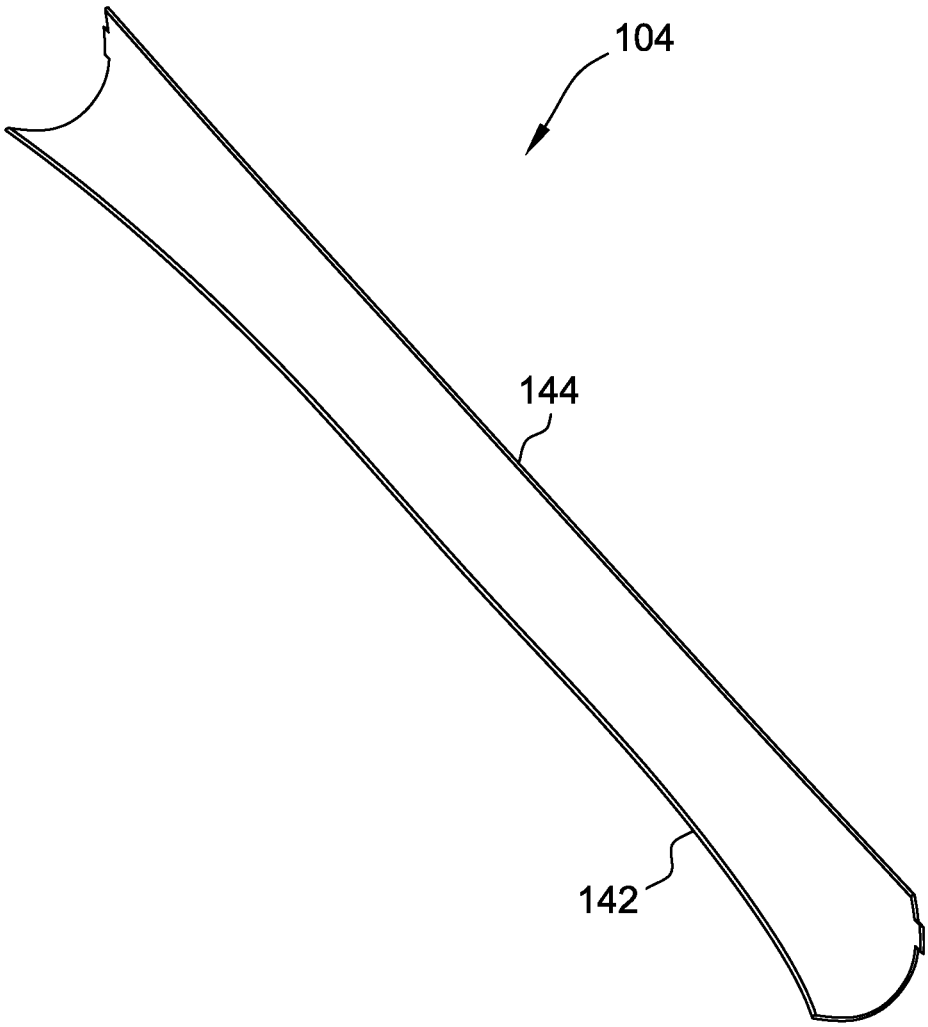
FIG. 5 is a schematic perspective view of an exemplary fan blade shown in FIG. 2.
Figure 6:
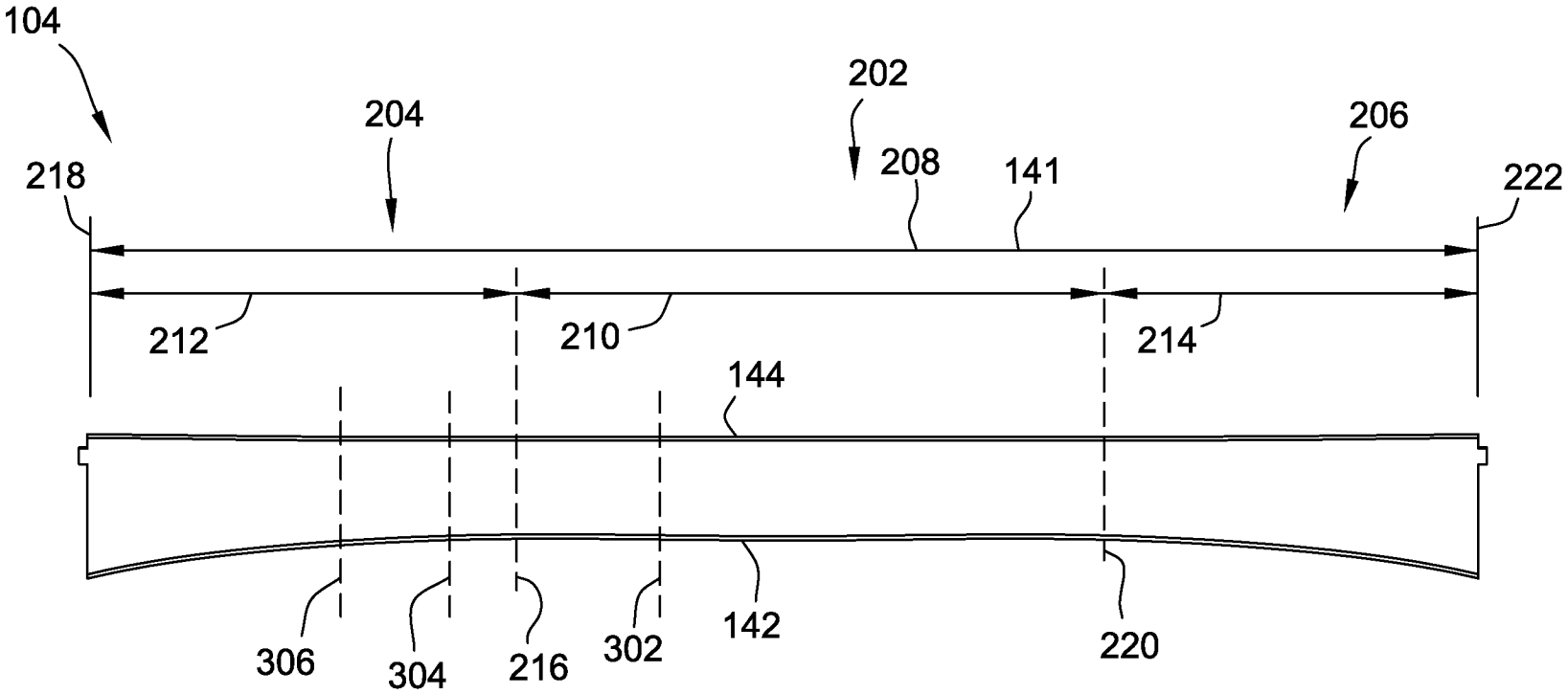
FIG. 6 is a schematic front view of an exemplary fan blade shown in FIG. 5.

FIG. 5 is a schematic perspective view of an exemplary fan blade 104. FIG. 6 is a schematic front view of an exemplary fan blade 104. Fan blade 104 may be suitably fabricated from any number of materials, including, but not limited to, a plastic or other flexible or compliant material. For example, fan blade 104 may be formed by a molding, forming, extruding, or three-dimensional printing process used for fabricating parts from thermoplastic or thermosetting plastic materials and/or metals. Alternatively, fan blade 104 may be fabricated from a combination of materials such as attaching a flexible or compliant material to a rigid material. Fan blade 104, however, may be constructed of any suitable material, such as metal, that permits fan blade 104 to operate as described herein.

In the exemplary embodiment, fan blade 104 includes a first portion or central portion 202, a second portion 204, and a third portion 206. In the exemplary embodiment, second portion 204 and third portion 206 are side portions positioned on either side of first portion 202. Second portion 204 is positioned on a first side of first portion 202 and third portion 206 is positioned on a second side of first portion 202. Second portion 204 extends from first portion 202 to front endring 138 (shown in FIGS. 2-3) and third portion 206 extends from first portion 202 to rear endring 140 (shown in FIGS. 2-3). Blade span 141 defines a blade length 208. First portion 202 defines a first portion length 210, second portion 204 defines a second portion length 212, and third portion 206 defines a third portion length 214. Blade length 208 is the sum of first portion length 210, second portion length 212, and third portion length 214. In the exemplary embodiment, first portion length 210 is about 50% of blade length 208, second portion length 212 is about 25% of blade length 208, and third portion length 214 is about 25% of blade length 208. Alternatively, first portion length 210, second portion length 212, and third portion length 214 may be any percentage of blade length 208 that enables blower assembly 100 to function as described herein.

In the exemplary embodiment, fan blade 104 has a constant outer radius 148 over blade length 208. That is, trailing edge 144 is shaped such that outer radius 148 is constant over first portion length 210, second portion length 212, and third portion length 214. In contrast, fan blade 104 has a variable inner radius 146 that varies over blade length 208. Specifically, first portion 202 has a constant inner radius 146 while second and third portions 204, 206 have variable inner radii 146. That is, leading edge 142 is shaped such that inner radius 146 is constant over first portion length 210 and decreases over second and third portion lengths 212, 214 away from first portion 202. Specifically, inner radius 146 of second portion 204 is equal to inner radius of first portion 202 at a first portion-second portion interface 216. Inner radius 146 decreases from first portion-second portion interface 216 to a second portion-front endring interface 218. Similarly, inner radius 146 of third portion 206 is equal to inner radius of first portion 202 at a first portion-third portion interface 220. Inner radius 146 decreases from first portion-third portion interface 220 to a third portion-rear endring interface 222.

In the exemplary embodiment, inner radius 146 of first portion 202, first portion-second portion interface 216, and first portion-third portion interface 220 is about 84% of the outer radius 148 to about 86% of the outer radius 148. Inner radius 146 of second portion-front endring interface 218 is about 81% of the outer radius 148 to about 83% of the outer radius 148. Inner radius 146 of third portion-rear endring interface 222 is about 81% of the outer radius 148 to about 83% of the outer radius 148. Alternatively, inner radius 146 of first portion 202, second portion 204, third portion 206, first portion-second portion interface 216, first portion-third portion interface 220, second portion-front endring interface 218, and third portion-rear endring interface 222 may be any length that enables blower assembly 100 to function as described herein.

Figure 7:
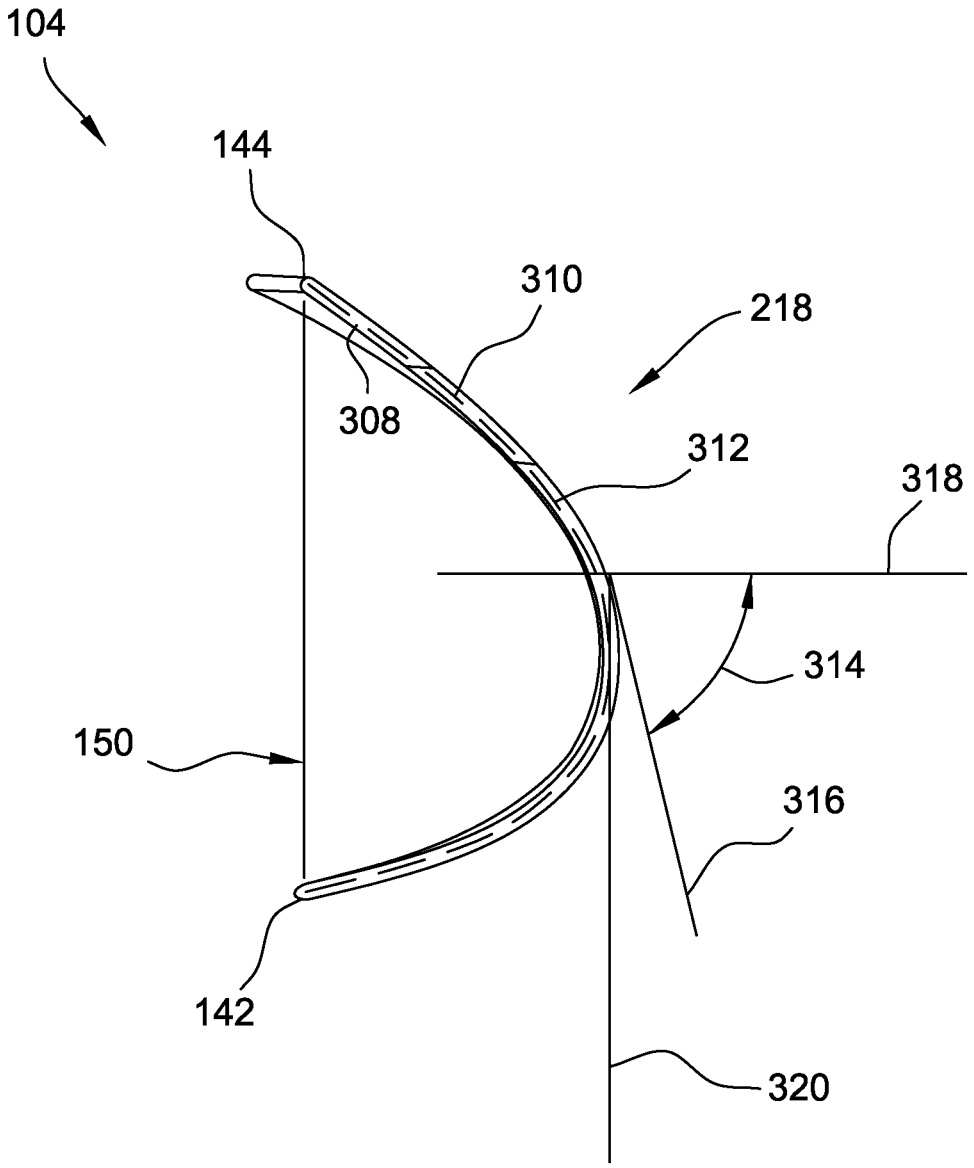
FIG. 7 is a schematic side view of an exemplary fan blade shown in FIG. 5.
Figure 8:
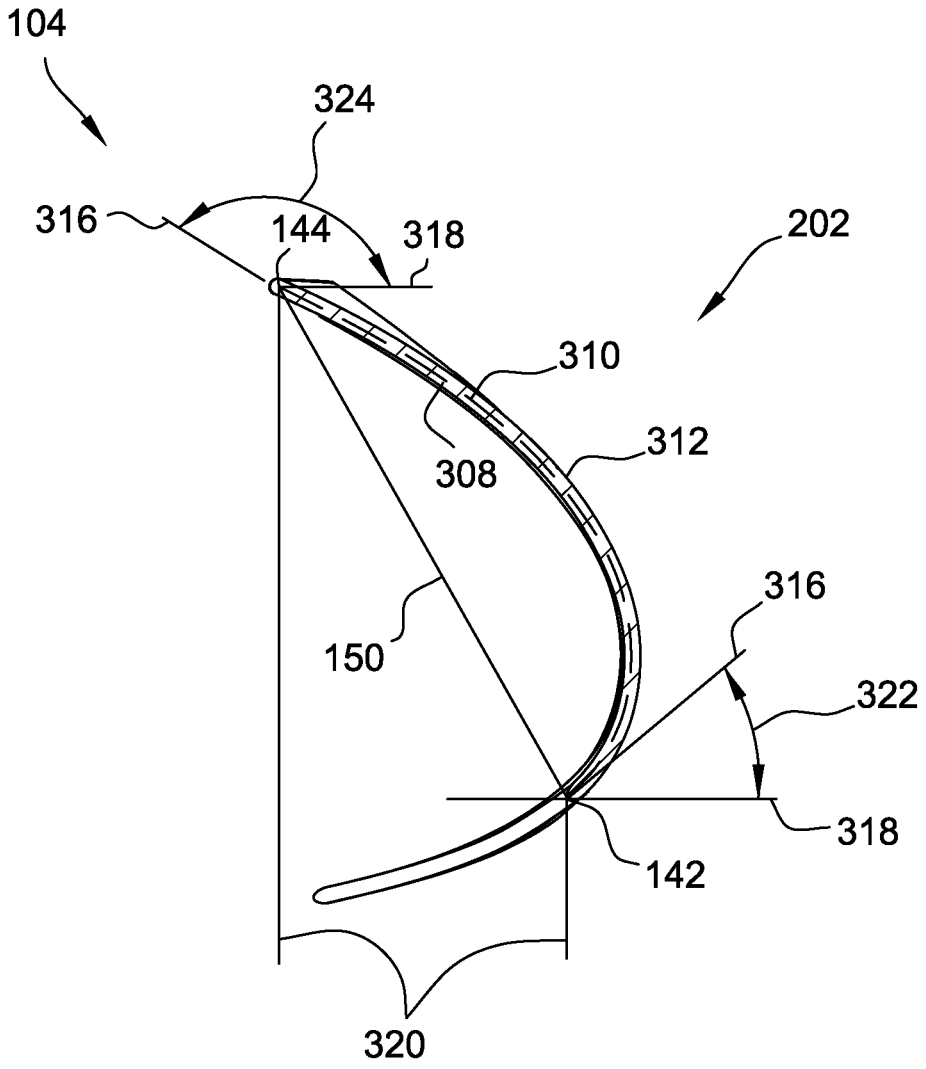
FIG. 8 is a first schematic sectional view of an exemplary fan blade shown in FIG. 5.
Figure 9:
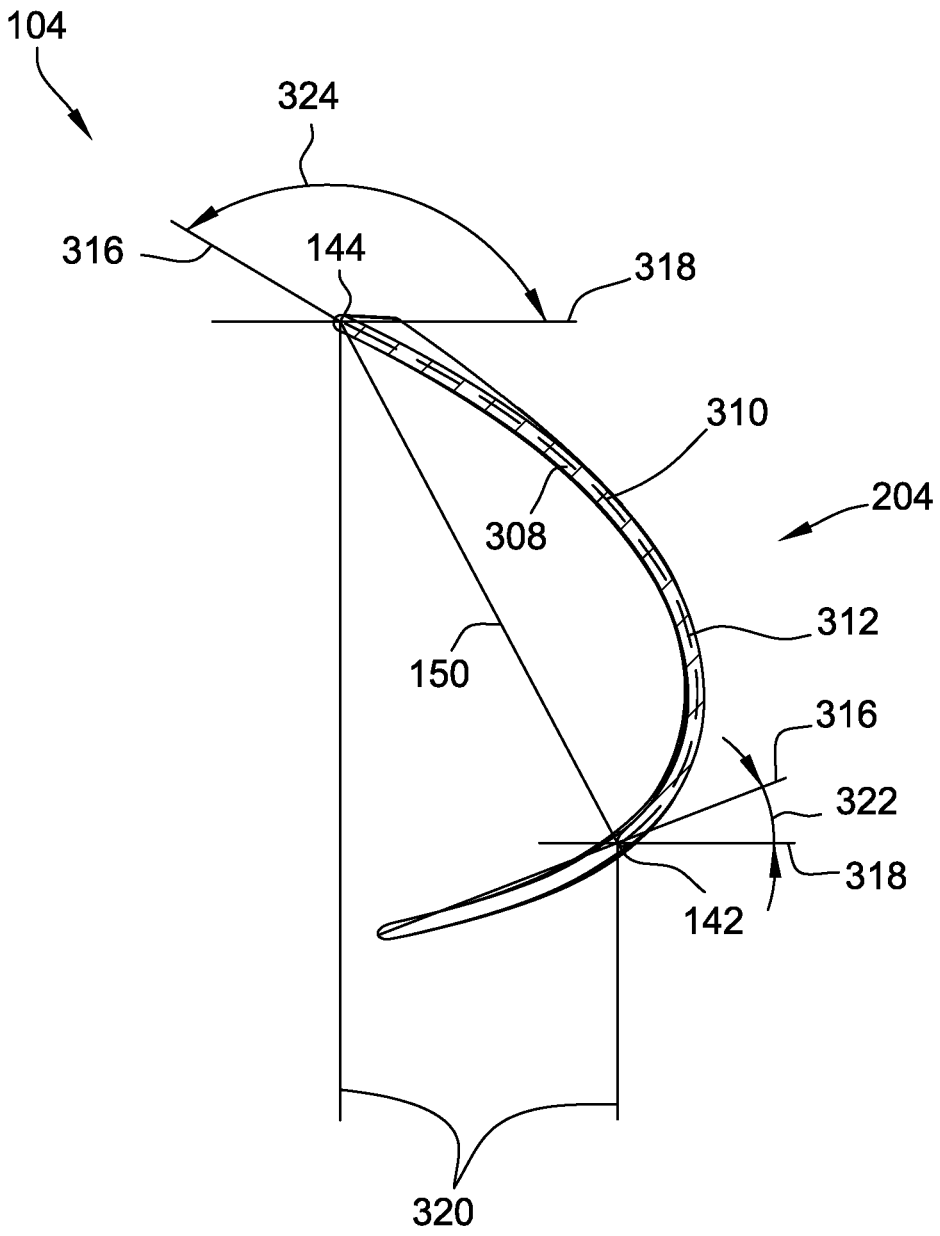
FIG. 9 is a second schematic sectional view of an exemplary fan blade shown in FIG. 5.
Figure 10:
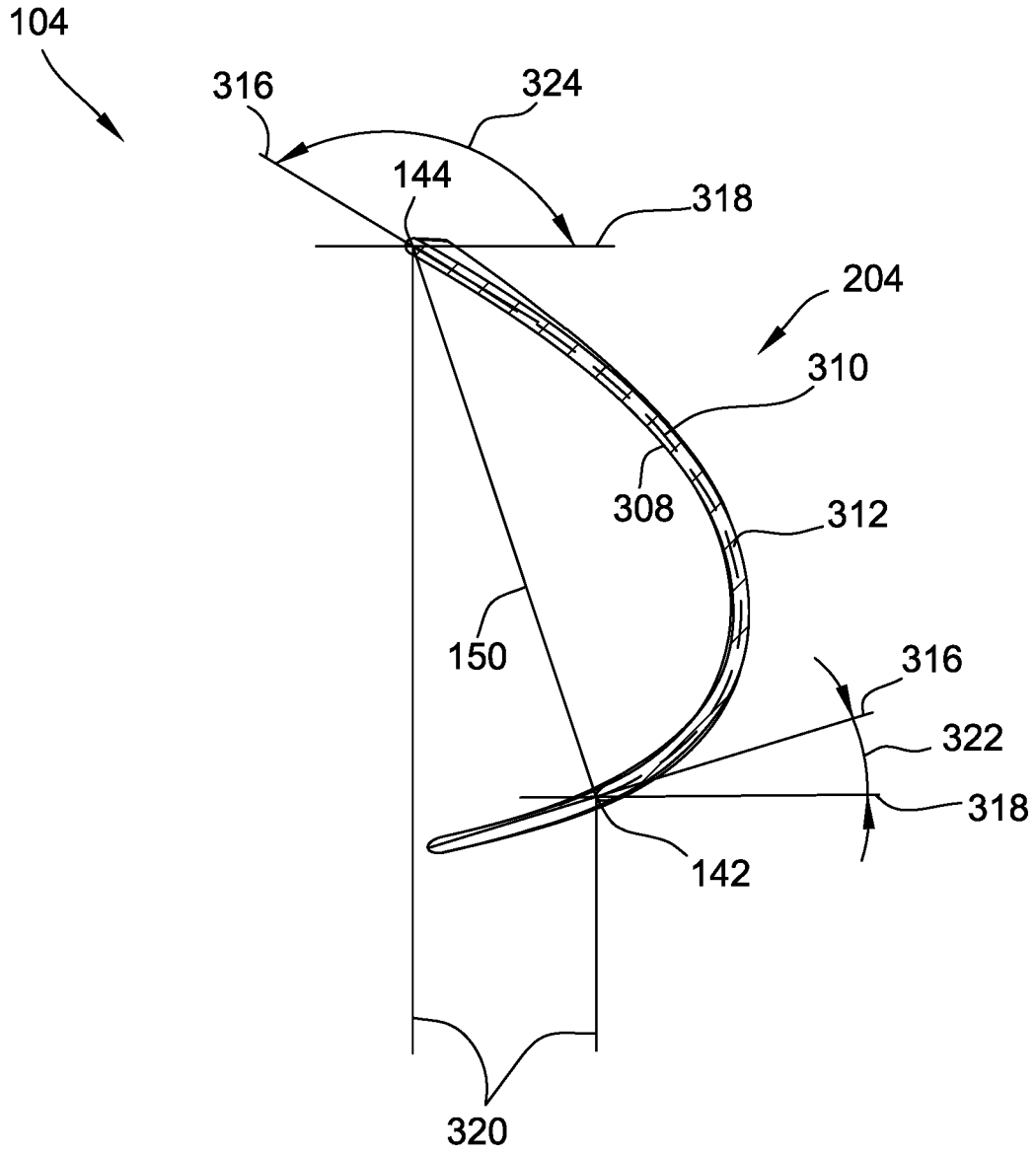
FIG. 10 is a third schematic sectional view of an exemplary fan blade shown in FIG. 5.

FIG. 7 is a schematic side view of an exemplary fan blade 104 at second portion-front endring interface 218. FIG. 8 is a schematic sectional view of a first point 302 within first portion 202. FIG. 9 is a schematic sectional view of a second point 304 within second portion 204. FIG. 10 is a schematic sectional view of a third point 306 within second portion 204. As shown in FIG. 6, third point 306 is positioned closer to second portion-front endring interface 218 than second point 304. Between leading edge 142 and trailing edge 144 of fan blade 104, fan blade 104 curves along a non-linear, arcuate path. The shape of fan blade 104 has a constantly changing rate of curvature such that a blade profile is not defined by a constant radius or by a combination of two or more unrelated radii. As such, fan blade 104 defines a blade profile having a continuously changing curvature from leading edge 142 to trailing edge 144. Fan blade 104 includes a pressure face 308 and a suction face 310 that each extend between leading and trailing edges 142 and 144. A camber line 312 is defined as a curve within fan blade 104 halfway between pressure face 308 and suction face 310. Camber line 312 has a blade angle 314 that increases between the leading edge 142 and the trailing edge 144 of fan blade 104. Referring to FIGS. 4 and 7-10, blade angle 314 of fan blade 104 at any point along camber line 312 is an angle between a first line 316 tangent to camber line 312 at that point and a second line 318 perpendicular to a third line 320 that intersects both that point and axis 120. As shown in FIGS. 7-10, leading edge 142 has a leading edge blade angle 322 and trailing edge 144 has a trailing edge blade angle 324.

Referring to FIG. 8, the shape of leading edge 142 and trailing edge 144 is constant within first portion 202 such that chord length 150, leading edge blade angle 322, trailing edge blade angle 324, inner radius 146, and outer radius 148 are constant over first portion length 210. In the exemplary embodiment, chord length 150 is about 1.0 inches to about 1.1 inches over first portion length 210. More particularly, chord length 150 is about 1.04 inches over first portion length 210. In the exemplary embodiment, leading edge blade angle 322 is about 30 degrees to about 60 degrees over first portion length 210. More particularly, leading edge blade angle 322 is about 45 degrees over first portion length 210. In the exemplary embodiment, trailing edge blade angle 324 is about 59 degrees to about 75 degrees over first portion length 210. More particularly, trailing edge blade angle 324 is about 67 degrees over first portion length 210. In the exemplary embodiment, inner radius 146 is about 84% of the outer radius 148 to about 86% of the outer radius 148 over first portion length 210. More particularly, inner radius 146 is about 85% of the outer radius 148 over first portion length 210. In the exemplary embodiment, outer radius 148 is about 5 inches to about 16 inches over first portion length 210. More particularly, outer radius 148 is about 11.93 inches over first portion length 210.

In contrast, the shape of leading edge 142 and trailing edge 144 varies within second portion 204 and third portion 206 such that leading edge blade angle 322, trailing edge blade angle 324, and inner radius 146 vary over second portion length 212 and third portion length 214. However, leading edge blade angle 322, trailing edge blade angle 324, and inner radius 146 are varied such that chord length 150 and outer radius 148 remain constant over second portion length 212 and third portion length 214. Additionally, blade solidity also remains constant as leading edge blade angle 322, trailing edge blade angle 324, and inner radius 146 are varied.

In the exemplary embodiment, second portion 204 and third portion 206 are symmetrical about first portion 202 and have substantially similar, symmetrical shapes. In alternative embodiments, second portion 204 and third portion 206 may have different, non-symmetrical shapes, or second portion 204 and third portion 206 may have any shape that enables blower assembly 100 to function as described herein. As such, the discussion below with regard to second portion 204 also applies to third portion 206.

Variable leading edge blade angle 322, trailing edge blade angle 324, and inner radius 146 are shown in FIGS. 7-10. Referring first to FIG. 8, the shape of leading edge 142 and trailing edge 144 at first portion-second portion interface 216 is the same as the shape of leading edge 142 and trailing edge 144 within first portion 202. As such, chord length 150, leading edge blade angle 322, trailing edge blade angle 324, inner radius 146, and outer radius 148 at first portion-second portion interface 216 is equal to chord length 150, leading edge blade angle 322, trailing edge blade angle 324, inner radius 146, and outer radius 148 within first portion 202 respectively.

FIG. 9 shows the shape of leading edge 142 and trailing edge 144 at second point 304 within second portion 204. Second point 304 is positioned closer to second portion-front endring interface 218 (shown in FIG. 6) than first portion-second portion interface 216. As shown, leading edge 142 at second point 304 is further forward and positioned further radially inward than leading edge 142 at first point 302 (shown in FIG. 8). As such, inner radius 146 decreased from first portion-second portion interface 216 to second point 304. Additionally, because the position of leading edge 142 has changed, leading edge blade angle 322 has also changed. Specifically, leading edge blade angle 322 decreased from first portion-second portion interface 216 to second point 304. As shown, trailing edge 144 at second point 304 is further backward than trailing edge 144 at first point 302. Because the position of trailing edge 144 has changed, trailing edge blade angle 324 has also changed. Specifically, trailing edge blade angle 324 decreased from first portion-second portion interface 216 to second point 304. However, trailing edge 144 at second point 304 maintains the same distance from axis 120 such that outer radius 148 at second point 304 is substantially equal to outer radius 148 at first point 302. Simultaneously varying inner radius 146, leading edge blade angle 322, and trailing edge blade angle 324 while maintaining a constant value for outer radius 148, allows chord length 150 and blade solidity to remain constant over blade span 141.

FIG. 10 shows the shape of leading edge 142 and trailing edge 144 at third point 306 within second portion 204. Third point 306 is positioned closer to second portion-front endring interface 218 (shown in FIG. 6) than second point 304. As shown, leading edge 142 at third point 306 is further forward and positioned further radially inward than leading edge 142 at second point 304 (shown in FIG. 9). As such, inner radius 146 decreased from second point 304 to third point 306. Additionally, because the position of leading edge 142 has changed, leading edge blade angle 322 has also changed. Specifically, leading edge blade angle 322 decreased from second point 304 to third point 306. As shown, trailing edge 144 at third point 306 is further backward than trailing edge 144 at second point 304. Because the position of trailing edge 144 has changed, trailing edge blade angle 324 has also changed. Specifically, trailing edge blade angle 324 decreased from second point 304 to third point 306. However, trailing edge 144 at third point 306 maintains the same distance from axis 120 such that outer radius 148 third point 306 is substantially equal to outer radius 148 at first point 302 and second point 304. Simultaneously varying inner radius 146, leading edge blade angle 322, and trailing edge blade angle 324 while maintaining a constant value for outer radius 148, allows chord length 150 and blade solidity to remain constant over blade span 141.

FIG. 7 shows the shape of leading edge 142 and trailing edge 144 at second portion-front endring interface 218 within second portion 204. As shown, leading edge 142 at second portion-front endring interface 218 is further forward and positioned further radially inward than leading edge 142 at third point 306 (shown in FIG. 10). As such, inner radius 146 decreased from third point 306 to second portion-front endring interface 218. Additionally, because the position of leading edge 142 has changed, leading edge blade angle 322 has also changed. Specifically, leading edge blade angle 322 decreased from third point 306 to second portion-front endring interface 218. As shown, trailing edge 144 at second portion-front endring interface 218 is further backward than trailing edge 144 at third point 306. Because the position of trailing edge 144 has changed, trailing edge blade angle 324 has also changed. Specifically, trailing edge blade angle 324 decreased from third point 306 to second portion-front endring interface 218. However, trailing edge 144 at second portion-front endring interface 218 maintains the same distance from axis 120 such that outer radius 148 at second portion-front endring interface 218 is substantially equal to outer radius 148 at first point 302, second point 304, and third point 306. Simultaneously varying inner radius 146, leading edge blade angle 322, and trailing edge blade angle 324 while maintaining a constant value for outer radius 148, allows chord length 150 and blade solidity to remain constant over blade span 141.

In the exemplary embodiment, chord length 150 is about 1.0 inches to about 1.1 inches over second portion length 212. More particularly, chord length 150 is about 1.04 inches over second portion length 212. In the exemplary embodiment, outer radius 148 is about 5 inches to about 16 inches over second portion length 212. More particularly, outer radius 148 is about 11.93 inches over second portion length 212.

In the exemplary embodiment, leading edge blade angle 322 is about 30 degrees to about 60 degrees at first portion-second portion interface 216. More particularly, leading edge blade angle 322 is about 45 degrees at first portion-second portion interface 216. In the exemplary embodiment, leading edge blade angle 322 is about 59 degrees to about 75 degrees at second portion-front endring interface 218. More particularly, leading edge blade angle 322 is about 67 degrees at second portion-front endring interface 218. As such, leading edge blade angle 322 varies from about 30 degrees to about 60 degrees at first portion-second portion interface 216 to about 65 degrees to about 75 degrees at second portion-front endring interface 218.

In the exemplary embodiment, trailing edge blade angle 324 is about 59 degrees to about 75 degrees at first portion-second portion interface 216. More particularly, trailing edge blade angle 324 is about 67 degrees at first portion-second portion interface 216. In the exemplary embodiment, trailing edge blade angle 324 is about 49 degrees to about 65 degrees at second portion-front endring interface 218. More particularly, trailing edge blade angle 324 is about 57 degrees at second portion-front endring interface 218. As such, trailing edge blade angle 324 varies from about 59 degrees to about 75 degrees at first portion-second portion interface 216 to about 49 degrees to about 65 degrees at second portion-front endring interface 218.

In the exemplary embodiment, inner radius 146 is about 84% of the outer radius 148 to about 86% of the outer radius 148 at first portion-second portion interface 216. More particularly, inner radius 146 is about 85% of the outer radius 148 at first portion-second portion interface 216. In the exemplary embodiment, inner radius 146 is about 81% of the outer radius 148 to about 83% of the outer radius 148 at second portion-front endring interface 218. More particularly, inner radius 146 is about 82% of the outer radius 148 at second portion-front endring interface 218. As such, inner radius 146 varies from about 84% of the outer radius 148 to about 86% of the outer radius 148 at first portion-second portion interface 216 to about 81% of the outer radius 148 to about 83% of the outer radius 148 at second portion-front endring interface 218.

In the exemplary embodiment, when impeller 102 is in operation, air enters through inlet 124 and is deflected radially outward from axis 120 towards fan blade 104. Fan blade 104 is configured to pull the air from inlet 124. The air passes between adjacent fan blades 104 and is forced outwards due to the centrifugal force generated by rotating fan blades 104. More specifically, the curvature of each fan blade 104 quickly changes the direction of airflow such that the air travels along fan blade 104 and is released into chamber 130, and exhausted through outlet 132. The continuously changing inner radius 146, leading edge blade angle 322, and trailing edge blade angle 324 along second portion 204 and third portion 206 allows fan blade 400 to uniformly distribute intake of air along blade span 141, increases the efficiency of blower assembly 100, reduces noise generated by blower assembly 100, and improves air flow within blower assembly 100.

Figure 11:
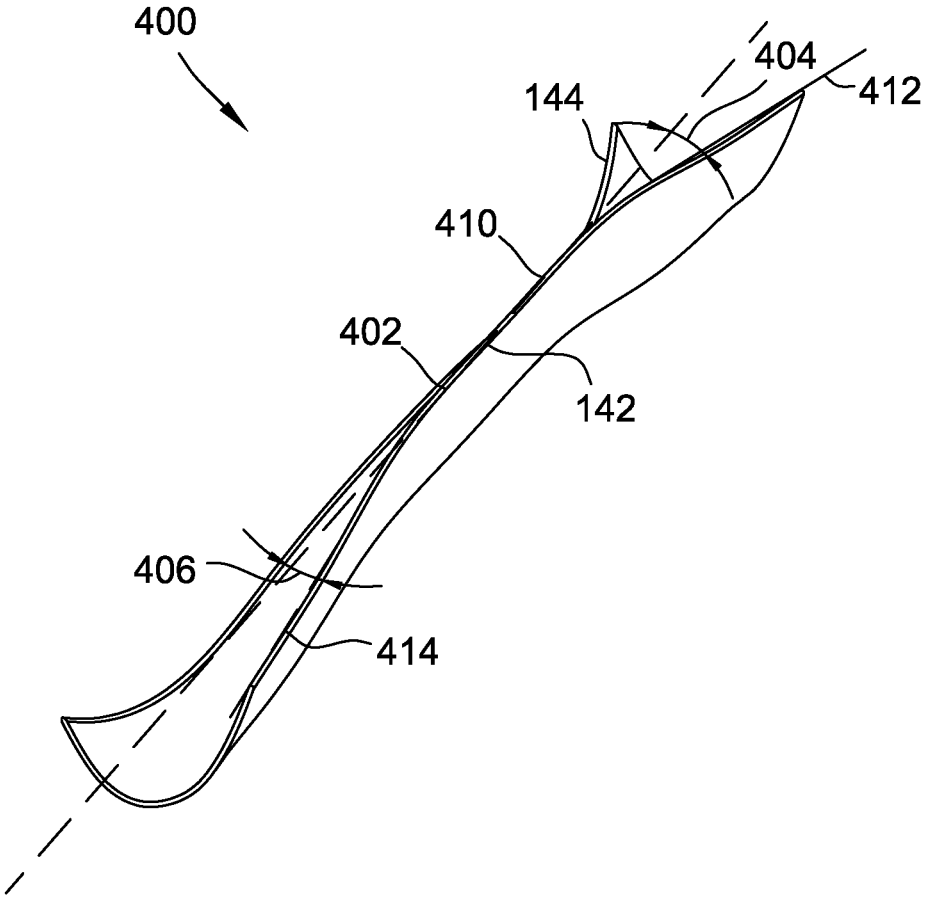
FIG. 11 is a schematic perspective view of another embodiment of an exemplary fan blade for use in the impeller shown in FIG. 2.
Figure 12:
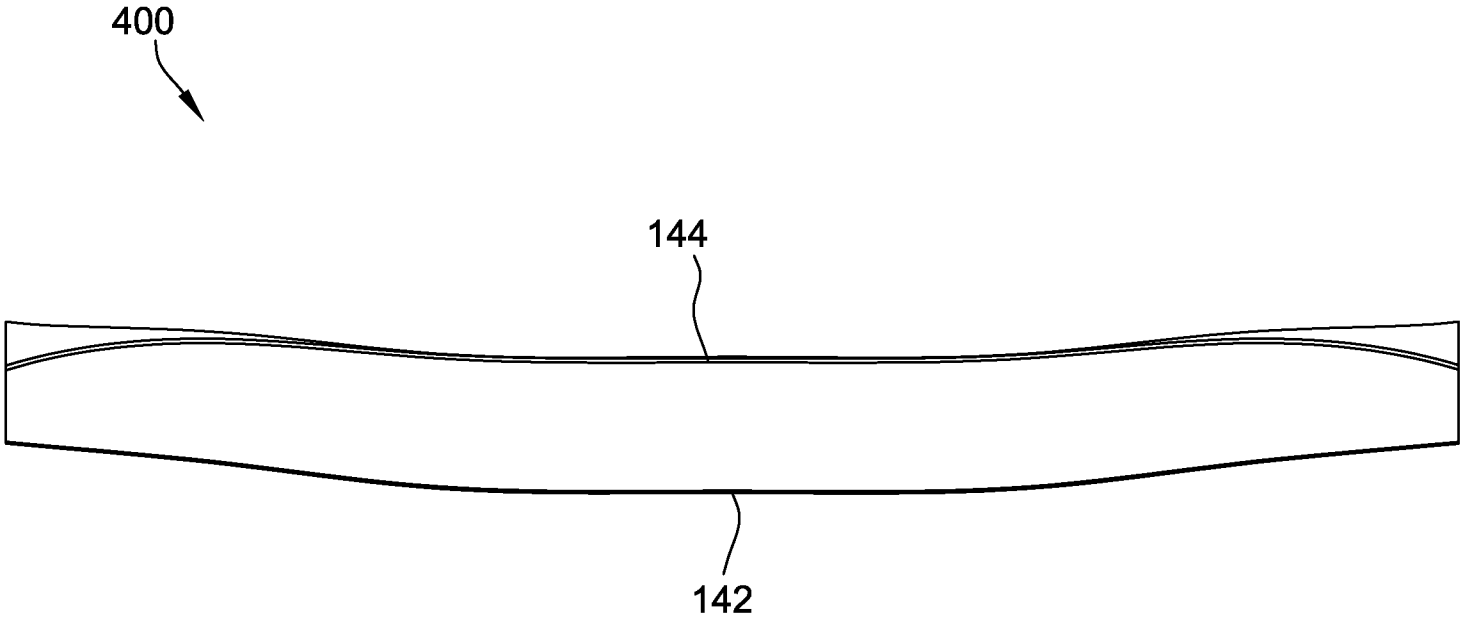
FIG. 12 is a schematic front view of an exemplary fan blade shown in FIG. 11.
Figure 13:
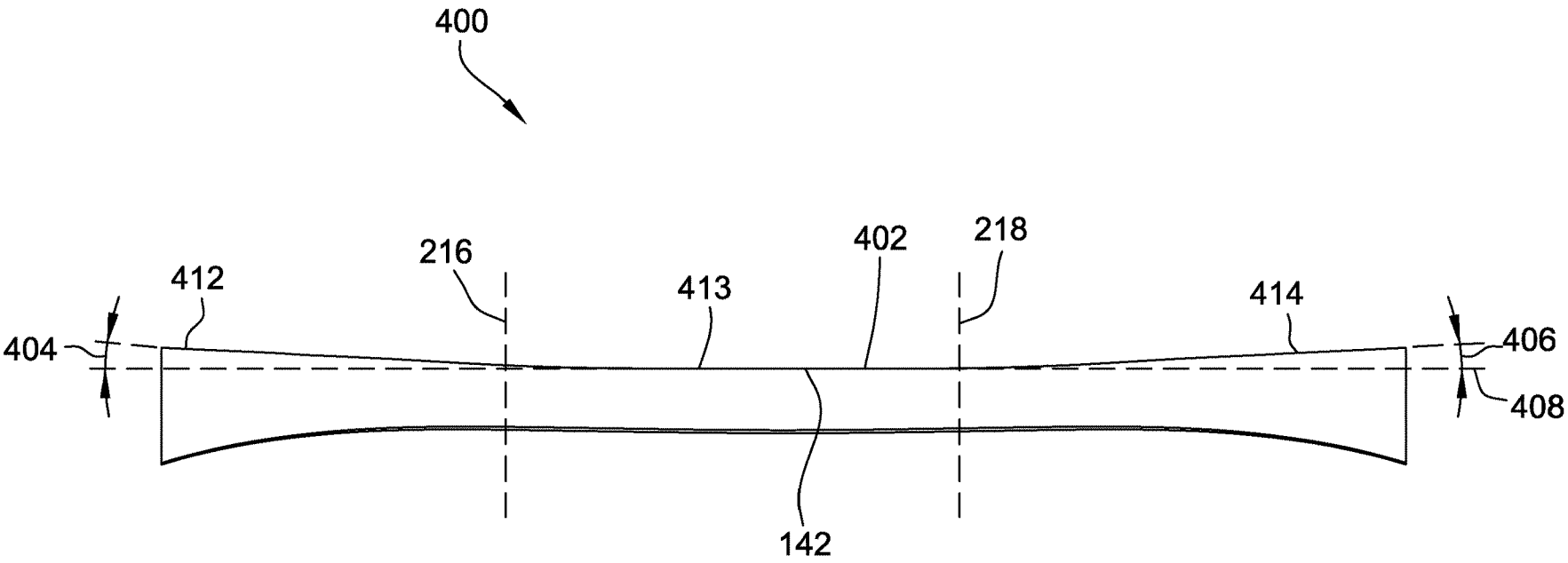
FIG. 13 is a schematic top view of an exemplary fan blade shown in FIG. 11.

FIG. 11 is a schematic perspective view of another embodiment of an exemplary fan blade 400. FIG. 12 is a schematic front view of another embodiment of an exemplary fan blade 400. FIG. 13 is a schematic top view of another embodiment of an exemplary fan blade 400. Fan blade 400 is similar to fan blade 104 except that first portion 202 has a first portion rake angle 402 that is different than a second portion rake angle 404 and a third portion rake angle 406. A rake angle is the angle between a blade tangent line at the trailing edge 142 of fan blade 400 and a radial plane 408 intersecting axis 120 and trailing edge 142 of first portion 202. In the exemplary embodiment, first portion rake angle 402 is the angle between radial plane 408 and a line 410 between first portion-second portion interface 216 and first portion-third portion interface 220. In the exemplary embodiment, first portion rake angle 402 is 0 degrees. In alternative embodiments, first portion rake angle 402 is any angle that enables blower assembly 100 to function as described herein. In the exemplary embodiment, second portion rake angle 404 is the angle between radial plane 408 and a line 412 between first portion-second portion interface 216 and second portion-front endring interface 218. In the exemplary embodiment, second portion rake angle 404 is about 1 degrees to about 5 degrees. In alternative embodiments, second portion rake angle 404 is any angle that enables blower assembly 100 to function as described herein. In the exemplary embodiment, third portion rake angle 406 is the angle between radial plane 408 and a line 414 between first portion-third portion interface 220 and third portion-rear endring interface 222. In the exemplary embodiment, third portion rake angle 406 is about 1 degrees to about 5 degrees. In alternative embodiments, third portion rake angle 406 is any angle that enables blower assembly 100 to function as described herein. Increasing second portion rake angle 404 and third portion rake angle 406 allows fan blade 400 to uniformly distribute intake of air along blade span 141. Specifically, increasing second portion rake angle 404 and third portion rake angle 406 allows fan blade 400 to intake more air closer to the ends of fan blade 400 (second portion-front endring interface 218 and third portion-rear endring interface 222).

Figure 14:
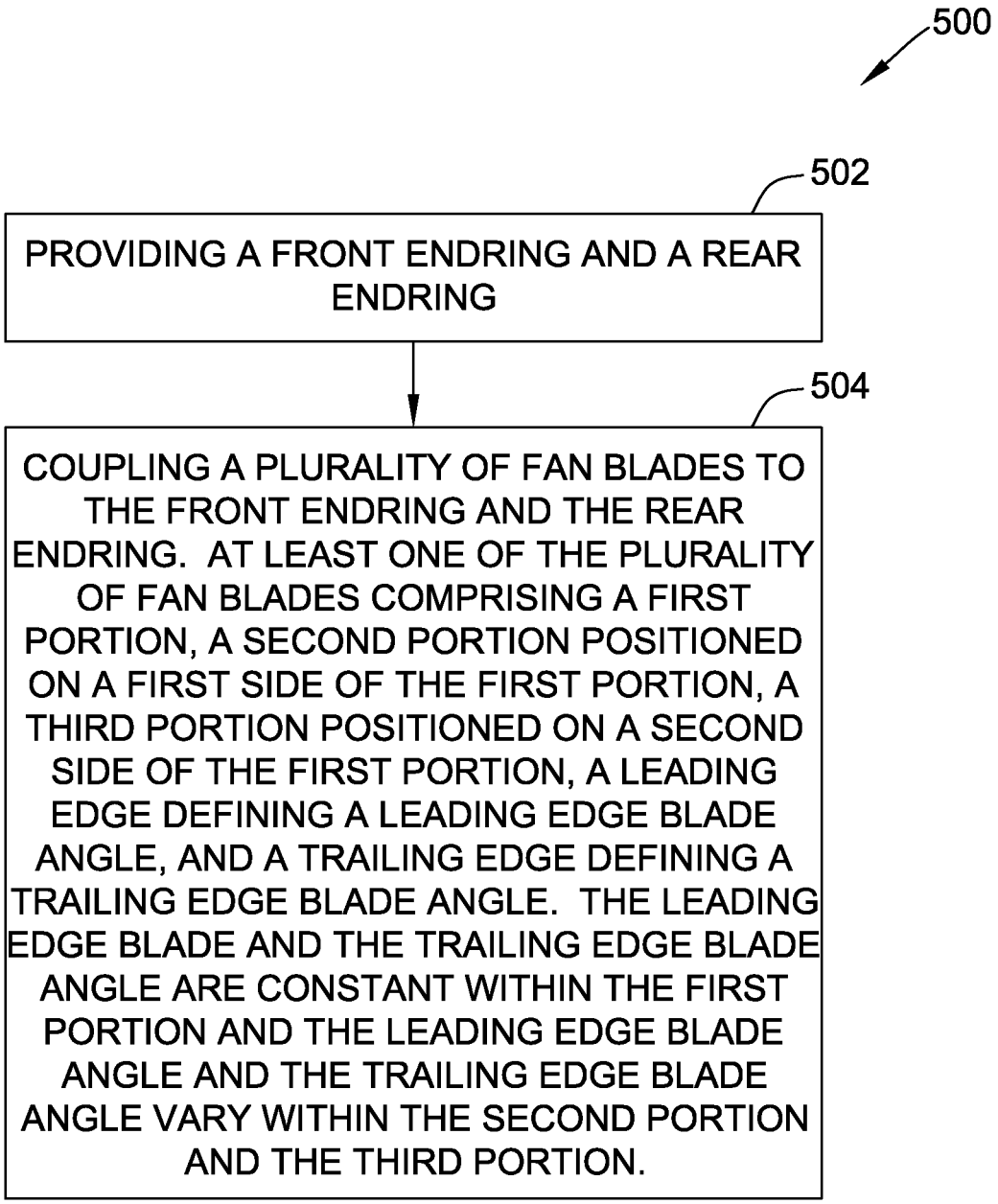
FIG. 14 is a flowchart of an exemplary method that may be used to assembling the impeller shown in FIG. 2.

FIG. 14 is a flow chart illustrating a method 500 for assembling impeller 102. Method 500 includes providing 502 front endring 138 and rear endring 140. Method 500 also includes coupling 504 a plurality of fan blades 104 to front endring 138 and rear endring 140. At least one of the plurality of fan blades 104 includes first portion 202, second portion 204 positioned on a first side of first portion 202, third portion 206 positioned on a second side of first portion 202, leading edge 142 defining leading edge blade angle 322, and trailing edge 144 defining trailing edge blade angle 324. Leading edge blade angle 322 and trailing edge blade angle 324 are constant within first portion 202 and leading edge blade angle 322 and trailing edge blade angle 324 vary within second portion 204 and third portion 206.

The apparatus described herein provide a centrifugal fan impeller having increased efficiency, reduced noise, and an improved airflow distribution across the span of the fan blades. One advantage to the blade profiles described herein is that the varying inner diameter, leading edge blade angle, and trailing edge blade angle allows the fan blade to uniformly distribute intake of air along the entire blade span. That is, the varying inner diameter, leading edge blade angle, and trailing edge blade angle allows the fan blade to intake more air closer to the ends of fan blade. Additionally, increasing the rake angles of the second and third portions also allows the fan blade to uniformly distribute intake of air along the entire blade span such that the fan blade intakes more air closer to the ends of fan blade.

Exemplary embodiments of a centrifugal blower assembly and a method for assembling the same are described above in detail. The methods and assembly are not limited to the specific embodiments described herein, but rather, components of the assembly and/or steps of the methods may be utilized independently and separately from other components and/or steps described herein. For example, the methods may also be used in combination with other air stream distribution systems and methods, and are not limited to practice with only the assembly and methods as described herein. Rather, the exemplary embodiment can be implemented and utilized in connection with many other air stream distribution applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A fan blade for a fan impeller, said fan blade coupled to a front endring and a rear endring defining a blade span therebetween, said fan blade comprising:

a first portion;

a second portion positioned on a first side of said first portion;

a third portion positioned on a second side of said first portion;

a leading edge defining a leading edge blade angle; and a trailing edge defining a trailing edge blade angle, wherein said leading edge blade angle and said trailing edge blade angle are constant within said first portion and said leading edge blade angle and said trailing edge blade angle vary continuously within each of said second portion and said third portion, wherein said leading edge and said trailing edge define a chord length therebetween, said chord length is constant over said blade span.

2. The fan blade in accordance with claim 1, wherein said fan blade is configured to rotate about an axis, said trailing edge and the axis define an outer radius, said outer radius is constant over said blade span.

3. The fan blade in accordance with claim 1, wherein said fan blade is configured to rotate about an axis, said leading edge and the axis define an inner radius, said inner radius varies continuously within each of said second portion and said third portion.

4. The fan blade in accordance with claim 3, wherein said inner radius is constant within said first portion.

5. The fan blade in accordance with claim 3, wherein said inner radius decreases continuously along a length of said second portion.

6. The fan blade in accordance with claim 3, wherein said inner radius decreases continuously along a length of said third portion.

7. A fan impeller comprising:

a front endring;

a rear endring; and a plurality of fan blades coupled between said front endring and said rear endring, each fan blade of said plurality of fan blades defining a blade span, between said front endring and said rear endring, at least one of said plurality of fan blades comprising:

a first portion;

a second portion positioned on a first side of said first portion;

a third portion positioned on a second side of said first portion;

a leading edge defining a leading edge blade angle; and a trailing edge defining a trailing edge blade angle, wherein said leading edge blade angle and said trailing edge blade angle are constant within said first portion and said leading edge blade angle and said trailing edge blade angle vary within said second portion and said third portion, wherein said leading edge and said trailing edge define a chord length therebetween, said chord length is constant over said blade span.

8. The fan impeller in accordance with claim 7, wherein said fan impeller is configured to rotate about an axis, said trailing edge and the axis define an outer radius, said outer radius is constant over said blade span.

9. The fan impeller in accordance with claim 7, wherein said fan impeller is configured to rotate about an axis, said leading edge and the axis define an inner radius, said inner radius varies continuously within each of said second portion and said third portion.

10. The fan impeller in accordance with claim 9, wherein said inner radius is constant within said first portion.

11. The fan impeller in accordance with claim 9, wherein said inner radius decreases continuously along a length of said second portion.

12. The fan impeller in accordance with claim 9, wherein said inner radius decreases continuously along a length of said third portion.

13. The fan impeller in accordance with claim 7, wherein said fan impeller defines a blade solidity, the blade solidity is defined as a ratio of a chord length of said at least one fan blade of said plurality of fan blades to a pitch of said at least one fan blade of said plurality of fan blades, wherein the blade solidity is constant over said blade span.

14. A method of assembling a fan impeller, said method comprising:

providing a front endring and a rear endring; and coupling a plurality of fan blades to the front endring and the rear endring, each fan blade of the plurality of fan blades defining a blade span, between the front endring and the rear endring, at least one of the plurality of fan blades comprising:

a first portion;

a second portion positioned on a first side of the first portion;

a third portion positioned on a second side of the first portion;

a leading edge defining a leading edge blade angle; and a trailing edge defining a trailing edge blade angle, wherein the leading edge blade angle and the trailing edge blade angle are constant within the first portion and the leading edge blade angle and the trailing edge blade angle vary continuously within each of the second portion and the third portion, wherein the fan impeller defines a blade solidity, the blade solidity is defined as a ratio of a chord length of the at least one fan impeller to a pitch of the at least one fan impeller, wherein the blade solidity is constant over the blade span.

15. The method in accordance with claim 14, wherein the leading edge and the trailing edge define a chord length therebetween, the chord length is constant over the blade span.

16. The method in accordance with claim 14, wherein the fan impeller is configured to rotate about an axis, the trailing edge and the axis define an outer radius, the outer radius is constant over the blade span.

17. The method in accordance with claim 14, wherein the fan impeller is configured to rotate about an axis, the leading edge and the axis define an inner radius, the inner radius varies continuously within each of the second portion and the third portion.

18. The method in accordance with claim 17, wherein the inner radius is constant within the first portion.

* * * * *